US007384610B2

(12) United States Patent
Lewis

(10) Patent No.: US 7,384,610 B2
(45) Date of Patent: Jun. 10, 2008

(54) METHOD AND MEANS OF DISPOSING OF HAZARDOUS WASTES CONNECTED WITH CRIMINAL ACTIVITY

(76) Inventor: Larry D Lewis, 3045 Snyder Ave., P.O. Box 112, Cedar, IA (US) 52543

( * ) Notice: Subject to any disclaimer, the term of this patent is extended or adjusted under 35 U.S.C. 154(b) by 595 days.

(21) Appl. No.: 10/894,316

(22) Filed: Jul. 19, 2004

(65) Prior Publication Data

US 2006/0011113 A1 Jan. 19, 2006

(51) Int. Cl.
*B01D 53/34* (2006.01)
*B09B 3/00* (2006.01)
*F23G 5/40* (2006.01)

(52) U.S. Cl. ..... 422/168; 422/169; 110/240; 110/241; 141/329; 588/900

(58) Field of Classification Search ..... None
See application file for complete search history.

(56) References Cited

U.S. PATENT DOCUMENTS 3,381,316 A * 5/1968 Anderson ..... 4/597
3,780,566 A * 12/1973 Smith et al. ..... 73/31.01
4,688,494 A * 8/1987 Domnitch ..... 110/240
5,237,938 A * 8/1993 Fujimori et al. ..... 110/240
5,339,752 A 8/1994 Lewis
5,383,499 A * 1/1995 Mattern ..... 141/51
5,727,481 A 3/1998 Voorhees et al.
6,179,522 B1 * 1/2001 Sanford et al. ..... 405/129.55
6,262,405 B1 7/2001 Wicks et al.
6,267,931 B1 * 7/2001 Nickens et al. ..... 422/171

* cited by examiner

*Primary Examiner*—Jennifer A Leung

(57) ABSTRACT

A method and apparatus are provided for disposing of hazardous waste associated with criminal activity, the apparatus having a burner assembly and a gas neutralizing assembly secured to a portable frame. The gas neutralizing assembly includes a rupture tank, a reservoir tank in communication with the rupture tank, a water tank in communication with the reservoir tank, and a vacuum pump operatively connected to the reservoir tank.

9 Claims, 3 Drawing Sheets

METHOD AND MEANS OF DISPOSING OF HAZARDOUS WASTES CONNECTED WITH CRIMINAL ACTIVITY

BACKGROUND OF THE INVENTION

The present invention relates to the safe disposal of hazardous waste associated with criminal activity and, more specifically, a method and means for safely disposing of the hazardous materials associated with the illegal production of methamphetamine.

Methamphetamine ("meth") has been a growing epidemic in the United States, in large part because it can be manufactured with readily available chemicals in the seclusion of one's own home. Meth traffickers typically manufacture meth in specially designed laboratories, which often are built in sheds, trailers, barns, or other rural settings. According to the Drug Enforcement Administration, meth traffickers operated more than 13,931 illegal meth labs in the United States between 1975 and 2001.

The production of meth involves a variety of hazardous chemicals, many of which can be found in household cleaners and products. One of the chemicals often used in the production of meth is anhydrous ammonia, which is a farm fertilizer commonly stored in large supply tanks on private farms across the country. Meth traffickers often use small pressure vessels, such as ordinary outdoor grill propane tanks, to hold anhydrous ammonia, which typically is stolen or obtained from the larger farm supply tanks. Anhydrous ammonia is extremely caustic and often difficult to safely contain. Most outdoor grill propane tanks have brass valves which corrode in the presence of anhydrous ammonia, leading to failure. Additionally, when anhydrous ammonia gas is pressurized, it becomes a super cool liquid, which often causes ice to form on typical outdoor grill propane tanks, also leading to potential failure of the pressure vessel.

After law enforcement discovers and shuts down an illegal meth lab, disposing of the hazardous chemicals and other materials involved in the production of meth is problematic, particularly for the disposal of anhydrous ammonia. Most local authorities lack the means or funds to properly dispose of these chemicals and often stockpile the chemicals and materials in remote locations until proper disposal can be accomplished. Because of the aggressive nature of anhydrous ammonia, allowing the gas to lay dormant in a storage facility creates an unsafe and potentially lethal situation. Additionally, because of the growing number of meth labs, local authorities are simply running out of room to store all of the hazardous chemicals and materials associated with meth production. Accordingly, there is a need for an improved method and means for safely disposing of the hazardous chemicals and materials associated with the illegal production of methamphetamine.

It is therefore a principal object of this invention to provide a method and means for the safe disposal of the hazardous wastes associated with criminal activity.

A further object of this invention is to provide a method and means for neutralizing anhydrous ammonia gas such that it can be safely disposed.

Still a further object of this invention is to provide a method and means for safely incinerating the materials associated with the illegal production of methamphetamine.

These and other objects will be apparent to those skilled in the art.

BRIEF SUMMARY OF THE INVENTION

The present invention is directed toward a method and apparatus for disposing of hazardous waste associated with criminal activity. The apparatus includes a burner assembly and a gas neutralizing assembly secured to a portable frame. The gas neutralizing assembly includes a rupture tank, a reservoir tank in communication with the rupture tank, a water tank in communication with the reservoir tank, and a vacuum pump operatively connected to the reservoir tank.

The method includes the steps of rupturing a container of hazardous gas in a pressurized tank, pressurizing the tank to cause the gas to liquefy under pressure, and mixing the liquefied gas with water. In this manner, the hazardous gas can be safely disposed.

DESCRIPTION OF THE PREFERRED EMBODIMENTS OF THE INVENTION

Figure 1:
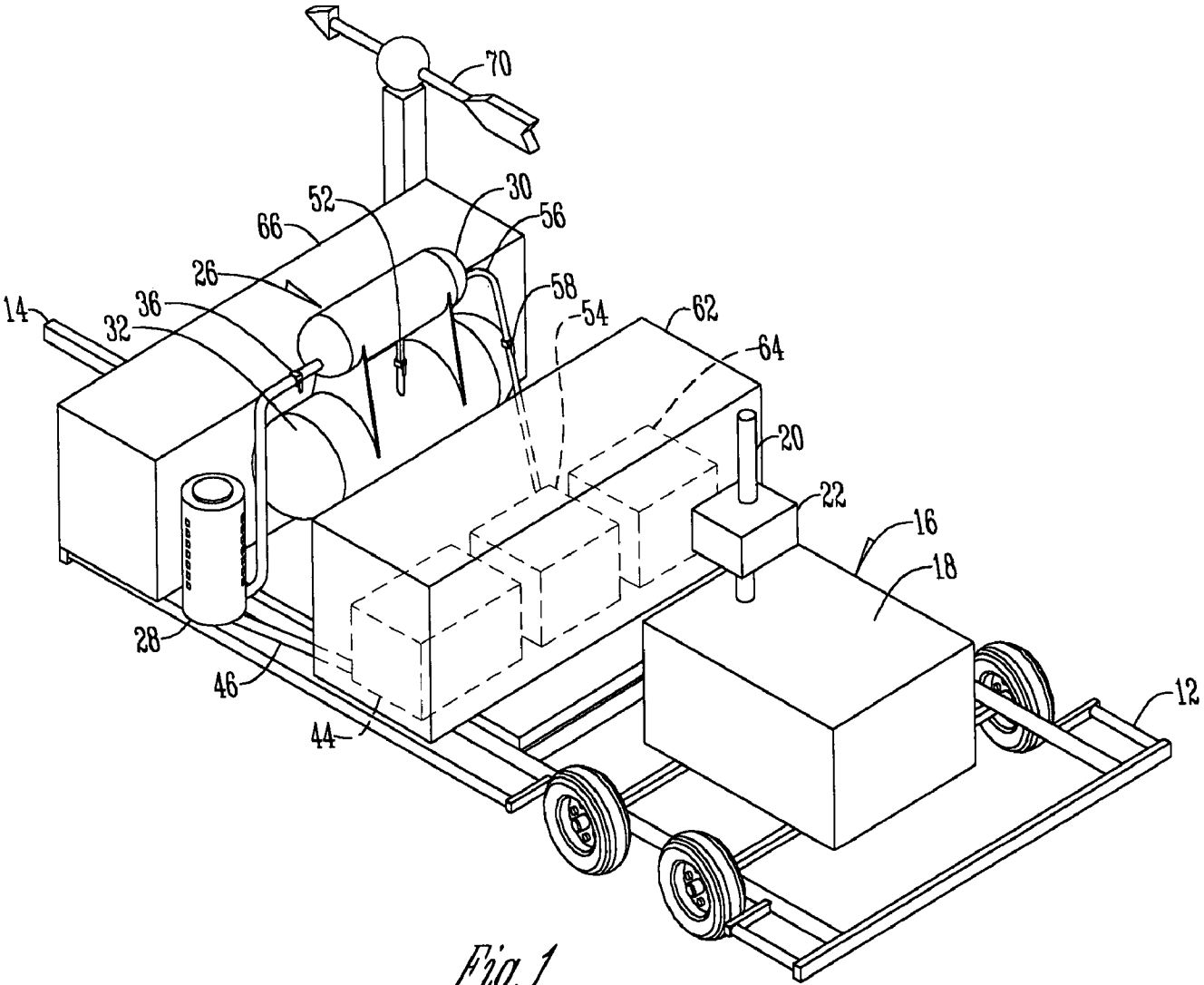
FIG. 1 is a perspective view of the present invention.

With reference to the figures, a portable meth lab disposal device 10 is shown having a frame 12 with a trailer hitch 14 for coupling the device 10 to a vehicle (not shown).

A burner assembly 16 is secured to the frame 12 and includes a main burner 18 having an exhaust stack 20 and an afterburner 22 operatively connected to the exhaust stack 20. The burner assembly 16 operates substantially the same as that disclosed in U.S. Pat. No. 5,339,752 to Lewis, which is incorporated by reference herein. Specifically, the main burner 18 is operatively connected to fuel tank 24 and incinerates waste placed therein. As the waste is incinerated, exhaust gases are created that are vented through exhaust stack 20. As the exhaust gases pass through exhaust stack 20, afterburner 22, which is operatively connected to fuel tank 24, further combusts the exhaust gases to ensure clean emissions. In this manner, the burner assembly 16 thoroughly incinerates the waste to produce safe and environmentally friendly by-products that can be safely disposed.

Figure 2:
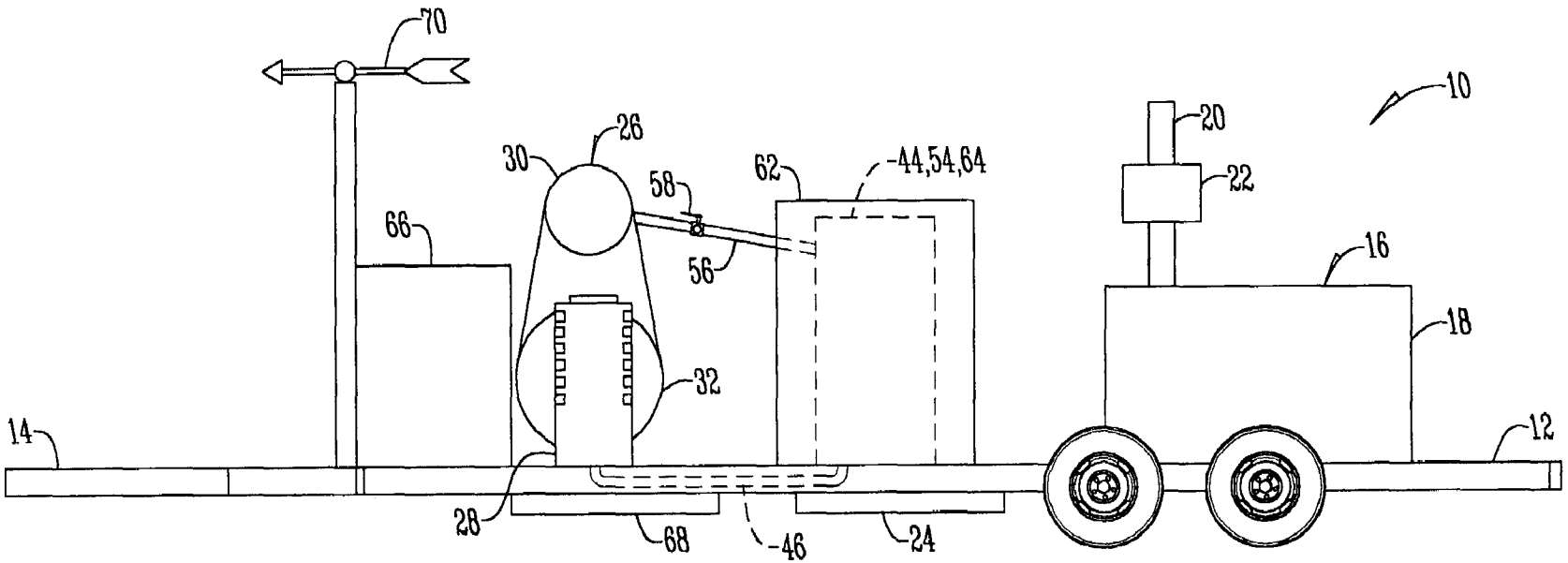
FIG. 2 is a side view of the present invention.

Fuel tank 24 is mounted underneath the frame 12, as shown in FIG. 2. To ensure thorough incineration and clean emissions, the fuel stored in fuel tank 24 and supplied to the burner assembly 16 preferably is a mixture of diesel fuel, Coleman® brand fuel (Coleman Co., Inc., Wichita, Kans.) or other kerosene-based fuel, and ether in equal parts.

Figure 3:
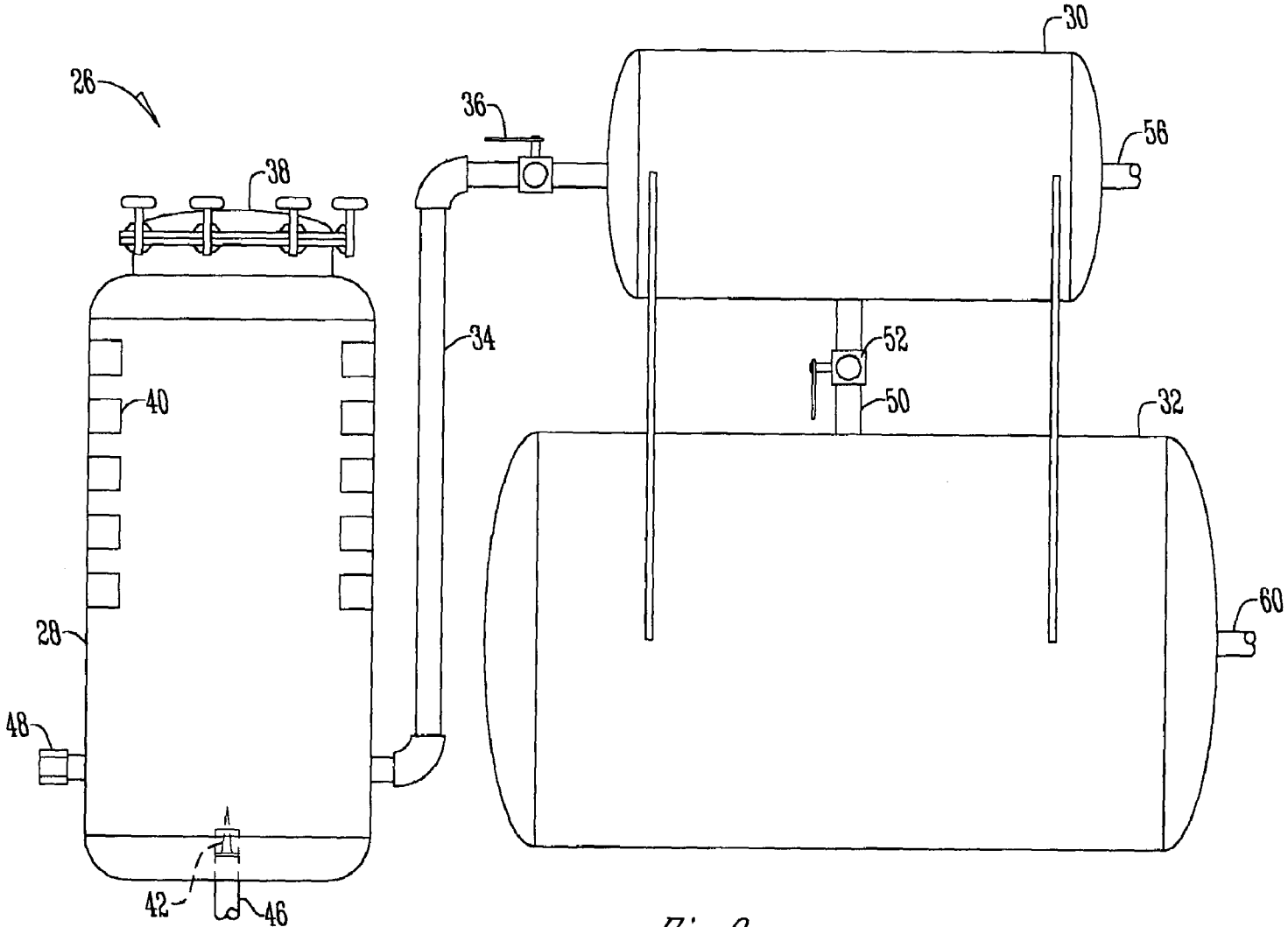
FIG. 3 is a side view of the gas neutralizing assembly of the present invention.

A gas neutralizing assembly 26 is secured to the frame 12 and includes a rupture tank 28, a reservoir tank 30, and a water tank 32. Rupture tank 28 is secured to the frame 12 and is in communication with reservoir tank 30 via piping 34, which is limited by valve 36. Rupture tank 28 has a sealable lid 38 that provides access to the interior of the tank 28, as best shown in FIG. 3. Notches 40 are provided on the interior wall of rupture tank 28 and are used for securing containers placed inside the tank 28, as described hereafter. A puncturing element 42 is disposed in the bottom of rupture tank 28 and is operatively connected to a hydraulic system 44 via piping 46. An air valve 48 is disposed in the side of the rupture tank 28 which allows air to be drawn into the tank 28 if needed. Preferably, air valve 48 is a check valve that allows air to enter tank 28 and prevents air or gas from escaping.

Reservoir tank 30 is mounted on top of water tank 32 and is in communication with water tank 32 via piping 50, which is limited by valve 52. Reservoir tank 30 also is in communication with a vacuum pump 54 via piping 56, which is limited by valve 58. Preferably, reservoir tank 30 has a volume of 100 gallons.

Water tank 32 is secured to the frame 12 and preferably has a volume of 200 gallons. Water tank 32 preferably is filled with 100 gallons of water during operation, as described hereafter. Solutions mixed in the water tank 32 can be discharged via piping 60.

Control housing 62 is secured to frame 12 and protects hydraulic system 44, vacuum pump 54, and an electric generator 64, which provides power to the hydraulic system and vacuum pump. Additionally, a back-up hydraulic system 44, vacuum pump 54, and electric generator 64 are disposed within control housing 62. Control housing 62 completely retracts to expose the components protected therein.

Waste storage housing 66 is secured to the frame 12 and provides storage for hazardous materials until proper disposal can be accomplished. Specifically, materials retrieved from the meth lab that cannot be incinerated in the burner assembly 16 or neutralized in the gas neutralization assembly 26 can be placed in waste storage housing 66 until the portable disposal device 10 can be brought to a hazardous disposal facility or the like where the stored materials can be properly discarded. Additionally, waste storage housing 66 provides temporary storage for empty containers of anhydrous ammonia or the like as well as the burnt remains of items incinerated in the burner assembly 16, which are preferably stored in plastic containers.

A second water tank 68 is secured underneath the frame 12 adjacent the fuel tank 24, as shown in FIG. 2. Water tank 68 preferably has a volume of 100 gallons and can be coupled to a hose and electric pump (not shown). In this manner, contaminated materials or persons can be dowsed at the site of the meth lab such that contamination is not spread further.

A weather vane 70 is mounted at the forward end of the frame 12, adjacent the waste storage housing 66. Weather vane 70 provides operators with wind direction, which may be crucial while disposing of hazardous materials at a meth lab. Specifically, while neutralizing hazardous gases, as described hereafter, it is important that the portable disposal device 10 be positioned such that the operator is upwind of the gas neutralizing assembly 26 such that the wind draws harmful gases away from the operator.

In operation, the portable disposal device 10 is towed by a vehicle (not shown) to the site of an illegal meth lab. The incineration and neutralization of hazardous waste is carried out at the site of the meth lab. Alternatively, because of the mobile nature of disposal device 10, the incineration and neutralization of hazardous materials is carried out while the device 10 is in transit.

Hazardous materials that can be incinerated, such as certain chemicals, clothing, and other instrumentalities used in the production of meth, are placed into the main burner 18 of the burner assembly 16. Main burner 18 and afterburner 22 thoroughly incinerate the hazardous materials to produce safe by-products that can be readily discarded. The burnt remains of items incinerated in the burner assembly 16 are placed in plastic containers and stored in waste storage housing 66 until the disposal device 10 can be brought to a hazardous waste facility or the like.

Containers of anhydrous ammonia and similar materials recovered at the site of a meth lab can be safely disposed in the gas neutralization assembly 26. Specifically, the container of anhydrous ammonia is placed inside the rupture tank 28 and is secured within the tank 28 via notches 40. After the lid 38 and air valve 48 are closed, the valves 36 and 58 are opened and vacuum pump 54 is operated to evacuate the rupture tank 28 and reservoir tank 30. After a vacuum has been created within the tanks 28 and 30, valve 58 is closed and vacuum pump 54 is turned off. Hydraulic system 44 is then operated to actuate puncturing element 42, which is driven into the container of anhydrous ammonia to rupture the container and release the gas. The rupture of the container of anhydrous ammonia is controlled by the hydraulic system 44. For instance, slowly releasing the puncturing element 42 from the container of anhydrous ammonia causes a slower, more controlled rupture. Because of the vacuum within the tanks 28 and 30, the anhydrous ammonia gas is drawn from the rupture tank 28 and into the reservoir tank 30, after which valve 36 is closed.

With the anhydrous ammonia gas contained within the reservoir tank 30, the hazardous gas is then neutralized. The first step involves pressurizing the gas to convert from a gas to a liquid. Specifically, check valve 58 is opened and vacuum pump 54 is actuated in reverse, thereby pressurizing the reservoir tank 30. The anhydrous ammonia gas, compressed by air from the vacuum pump 54, is converted to liquid form.

The next step in neutralizing the anhydrous ammonia involves mixing the liquefied gas with water to create an aqua ammonia solution, which is a common farm fertilizer that is more safe to handle as compared to anhydrous ammonia gas. Specifically, valve 52 is opened such that the liquefied gas passes from the reservoir tank 30 into the water tank 32. With the water tank 32 approximately half full of water, the liquefied anhydrous ammonia gas mixes with the water to form aqua ammonia. The aqua ammonia can then be transferred from the water tank 32 via piping 60 to a sprayer (not shown) for applying the fertilizer on farmlands or the like. Alternatively, the aqua ammonia can be transferred from the water tank 32 to a farm implement (not shown) for knifing the fertilizer directly into the ground. In addition, structure can be provided on the disposal device 10 that allows an operator to drive the device 10 into a field and knife the aqua ammonia into the ground directly from the device.

Other hazardous wastes recovered from the site of a meth lab that cannot be incinerated or neutralized, as described above, are stored in the waste storage housing 66 until proper disposal can be accomplished. Additionally, empty containers of anhydrous ammonia and the burnt remains of items incinerated in burner assembly 16 can be temporarily stored in waste storage housing 66. Further, water from water tank 68 can be used to wash hazardous materials prior to placement in the waste storage housing 66, or to shower people contaminated at the site.

It is therefore seen that by the use of a gas neutralization assembly and burner assembly, this invention permits the safe disposal of anhydrous ammonia and other hazardous materials associated with the illegal production of methamphetamine.

What is claimed is:

1. An apparatus for disposing of hazardous waste associated with criminal activity comprising:

a frame;

a burner assembly secured to the frame;

wherein the burner assembly comprises a main burner operatively connected to an afterburner; and wherein when hazardous materials are placed into the main burner, the main burner and afterburner incinerate the hazardous materials; and a gas neutralizing assembly secured to the frame, wherein the gas neutralizing assembly comprises a rupture tank having a means for rupturing a container of hazardous gas placed inside the rupture tank, a reservoir tank in communication with the rupture tank via a first pipe, a water tank in communication with the reservoir tank via a second pipe, and a vacuum pump operatively connected to the reservoir tank via a third pipe, the reservoir tank being mounted on top of the water tank;

wherein the vacuum pump is operable to generate a vacuum within the rupture tank and the reservoir tank in order to draw the hazardous gas from the rupture tank into the reservoir tank via the first pipe;

wherein the vacuum pump is further operable in reverse, to thereby pressurize the reservoir tank and convert the hazardous gas within the reservoir tank into a liquid form; and wherein the water tank receives the liquefied hazardous gas from the reservoir tank via the second pipe, to mix with water contained in the water tank.

2. The device of claim 1 wherein a waste storage container is secured to the frame.

3. The device of claim 1 wherein a shower assembly is secured to the frame, the shower assembly having a separate water tank, a pump, and a hose.

4. The device of claim 1 wherein a weather vane is secured to the frame.

5. A gas neutralizing assembly for disposing of hazardous gas associated with criminal activity comprising:

a rupture tank having a means for rupturing a container of hazardous gas placed inside the rupture tank;

a reservoir tank in communication with the rupture tank via a first pipe;

a water tank in communication with the reservoir tank via a second pipe; and a vacuum pump operatively connected to the reservoir tank via a third pipe;

wherein the reservoir tank is mounted on top of the water tank;

wherein the vacuum pump is operable to generate a vacuum within the rupture tank and the reservoir tank in order to draw the hazardous gas from the rupture tank into the reservoir tank via the first pipe;

wherein the vacuum pump is further operable in reverse, to thereby pressurize the reservoir tank and convert the hazardous gas within the reservoir tank into a liquid form; and wherein the water tank receives the liquefied hazardous gas from the reservoir tank via the second pipe, to mix with water contained in the water tank.

6. The device of claim 5 wherein the means for rupturing the container comprises a hydraulic means.

7. The device of claim 5 wherein a valve on the first pipe limits the flow of hazardous gas between the rupture tank and the reservoir tank.

8. The device of claim 5 wherein a valve on the second pipe limits the flow of liquefied hazardous gas between the reservoir tank and the water tank.

9. The device of claim 5 wherein a valve on the third pipe limits the communication between the reservoir tank and the vacuum pump.

* * * * *